US010646887B2

(12) United States Patent
Boileau et al.

(10) Patent No.: US 10,646,887 B2
(45) Date of Patent: May 12, 2020

(54) DISPENSING MEMBER AND DISPENSER COMPRISING SUCH A MEMBER

(71) Applicant: APTAR FRANCE SAS, Le Neubourg (FR)

(72) Inventors: Beatrice Boileau, Vitot (FR); Alexis Juttier-Lepifre, Rouen (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 16/072,292

(22) PCT Filed: Feb. 14, 2017

(86) PCT No.: PCT/FR2017/050327
§ 371 (c)(1),
(2) Date: Jul. 24, 2018

(87) PCT Pub. No.: WO2017/140976
PCT Pub. Date: Aug. 24, 2017

(65) Prior Publication Data

US 2019/0030557 A1 Jan. 31, 2019

(30) Foreign Application Priority Data

Feb. 19, 2016 (FR) ..... 16 51351

(51) Int. Cl.
*B05B 11/00* (2006.01)

(52) U.S. Cl.
CPC .... *B05B 11/00442* (2018.08); *B05B 11/0013* (2013.01); *B05B 11/3047* (2013.01);
(Continued)

(58) Field of Classification Search
CPC ..... B05B 11/0042; B05B 11/0013; B05B 11/3047
(Continued)

(56) References Cited

U.S. PATENT DOCUMENTS 3,762,647 A 10/1973 Tada
5,518,147 A 5/1996 Peterson et al.
(Continued)

FOREIGN PATENT DOCUMENTS

BE 788 042 A1 12/1972
EP 1 433 534 A2 6/2004
(Continued)

OTHER PUBLICATIONS

International Preliminary Report on Patentability dated Aug. 23, 2018 from the International Bureau in counterpart International Application No. PCT/FR2017/050327.
(Continued)

*Primary Examiner* — Jeremy Carroll
(74) *Attorney, Agent, or Firm* — Sughrue Mion, PLLC

(57) ABSTRACT

A dispenser member, such as a pump or a valve, including a body defining an inlet tube and in which a valve rod is axially movable back and forth, the body being provided with a vent lip that extends around the body, pointing outwards and downwards towards the inlet tube, thereby defining an outer edge that is not in contact with the body, the vent lip being formed by a sleeve that is engaged axially around the body to form a seal between them, the sleeve forming a leaktight sheath that is engaged in leaktight manner around the inlet tube of the body;

the dispenser member being characterized in that the vent lip is situated axially above the sealing sheath.

14 Claims, 2 Drawing Sheets

(52) U.S. Cl.
CPC ..... *B05B 11/0032* (2013.01); *B05B 11/0039* (2018.08); *B05B 11/0059* (2013.01)

(58) Field of Classification Search
USPC ..... 222/321.7
See application file for complete search history.

(56) References Cited

U.S. PATENT DOCUMENTS

| | | | | |
|---|---|---|---|---|
| 6,119,897 | A * | 9/2000 | Boileau | B05B 11/3042 222/78 |
| 6,189,741 | B1 * | 2/2001 | Behar | B05B 11/0013 222/321.7 |
| 8,875,946 | B2 * | 11/2014 | Muller | B05B 15/00 222/113 |
| 2004/0124212 | A1 * | 7/2004 | Masuda | B05B 11/0013 222/183 |
| 2005/0274745 | A1 * | 12/2005 | Bougamont | B05B 11/0013 222/321.9 |
| 2014/0042189 | A1 * | 2/2014 | Brahim | B05B 11/3047 222/321.1 |

FOREIGN PATENT DOCUMENTS

| | | | |
|---|---|---|---|
| WO | 97/26997 | A1 | 7/1997 |
| WO | 2010/089599 | A2 | 8/2010 |

OTHER PUBLICATIONS

International Search Report of PCT/FR2017/050327 dated Jun. 2, 2017.

* cited by examiner

DISPENSING MEMBER AND DISPENSER COMPRISING SUCH A MEMBER

CROSS REFERENCE TO RELATED APPLICATIONS

This is a National Stage of International Application No. PCT/FR2017/050327 filed Feb. 14, 2017, claiming priority based on French Patent Application No. 1651351 filed Feb. 19, 2016.

The present invention relates to a dispenser member, such as a pump or a valve, including a body defining a fluid inlet and in which a valve rod is axially movable back and forth. The dispenser member is generally assembled on a fluid reservoir and is also provided with an actuator head, e.g. in the form of a pusher that incorporates a fluid dispenser orifice. Advantageous fields of application of the present invention are the fields of perfumery, cosmetics, and pharmacy.

When the dispenser member takes fluid from the reservoir, it is common practice to allow outside air to penetrate into the reservoir so that suction is not generated inside the reservoir, which could be detrimental to, or even prevent, the operation of the dispenser member. Allowing outside air to penetrate into the reservoir is more commonly known by the term "venting".

When the dispenser is intended to be used with the dispenser member arranged above the reservoir, venting may take place through the dispenser member which includes an internal vent system. Specifically, the top portion of the reservoir is always empty of fluid, which avoids any risk of leaking. In contrast, in dispensers that are used with the dispenser member arranged below the reservoir, the dispenser member is always immersed in the fluid, and an internal vent system could cause fluid leaks.

In the prior art, FR 2 792 915 is known, which describes a dispenser that is intended to be used upsidedown, i.e. with the dispenser member arranged below the fluid reservoir. In order to guarantee venting of the reservoir without risk of fluid leaking, a cylindrical skirt is provided in which the body of the pump is received. The skirt is elastically deformable so as to form a check valve for venting, and it is shaped to bear in leaktight manner against the pump body, and to move away from said pump body under the effect of suction within the reservoir while the pump is being actuated. In other words, in that dispenser, the pump body performs the function of a valve seat for the cylindrical skirt that is deformable under the effect of suction.

However, in use, it turns out that the cylindrical vent skirt is leaky, such that fluid from the reservoir can leak between the skirt and the pump body. The cause of the leaks has not been formally identified, but very probably they come from deformation of the pump body resulting from its assembly, or from operation of the pump, given the high pressures that are generated inside the pump body. Whatever the cause, that particular configuration is not considered effective and reliable.

An object of the present invention is to remedy the above-mentioned prior-art drawbacks by defining a dispenser member that is capable of venting without risk of leakage, even when used upsidedown with the dispenser member situated below the fluid reservoir.

To achieve these objects, the present invention proposes that the body is provided with a vent lip that extends around the body, pointing outwards, thereby defining an outer edge that is not in contact with the body. The vent lip is for coming selectively into leaktight contact with a stationary element of the dispenser, e.g. the fastener ring of the dispenser member, or even the fluid reservoir, in particular at the inside wall of its neck. Thus, venting does not occur between the lip and the body of the dispenser member, but rather between the vent lip and another part of the dispenser.

The vent lip points down towards the inlet tube that forms the fluid inlet. This orientation is explained by the fact that air comes from outside and must deform the vent lip.

The vent lip is formed by a sleeve that is engaged axially around the body, establishing sealing between them. The sleeve forms a sealing sheath that is engaged in leaktight manner around the inlet tube of the body. Specifically, it is easier to create sealing at the inlet tube of the body, which inlet tube presents a diameter that is much smaller than the diameter of the main portion of the body. Furthermore, sealing occurs at the end of engagement, which reduces friction forces while engaging the sleeve around the pump body.

In addition, the vent lip is situated axially above the sealing sheath. Thus, sealing of the sleeve on the pump body is completely decoupled from the venting function. In other words, even if the sealing sheath is deformed, said sealing sheath will not affect proper operation of the vent lip.

In another practical aspect, the sleeve may form axial contact splines at the vent lip, the axial contact splines coming into bearing contact with the body. The axial contact splines make it easy to engage the sleeve around the body, without generating excessive friction forces, while guaranteeing good stability to the vent lip around the body.

The present invention also defines a dispenser including a dispenser member as defined above, the dispenser member being assembled on a fluid reservoir by means of a fastener ring, the outer edge of the vent lip coming into leaktight contact with the fastener ring or with the fluid reservoir. In an embodiment, the dispenser member is assembled in non-leaktight manner on the fastener ring. In a variant, the fastener ring includes a vent hole. In still another variant, venting may take place through the dispenser member, when said dispenser member includes an internal vent system.

The present invention also seeks to protect not only the use of such a dispenser with the fluid reservoir arranged above the dispenser member, in particular while the dispenser is being actuated, but also to protect the dispenser when it is at rest.

The principle of the present invention resides in the fact that the dispenser member is provided with a vent lip, but that the vent lip does not co-operate with the body of the dispenser member, and on the contrary it co-operates with the fastener ring of the dispenser member or even directly with the fluid reservoir.

The invention is described more fully below with reference to the accompanying drawings, which show three embodiments of the invention by way of non-limiting example.

Figure 2:
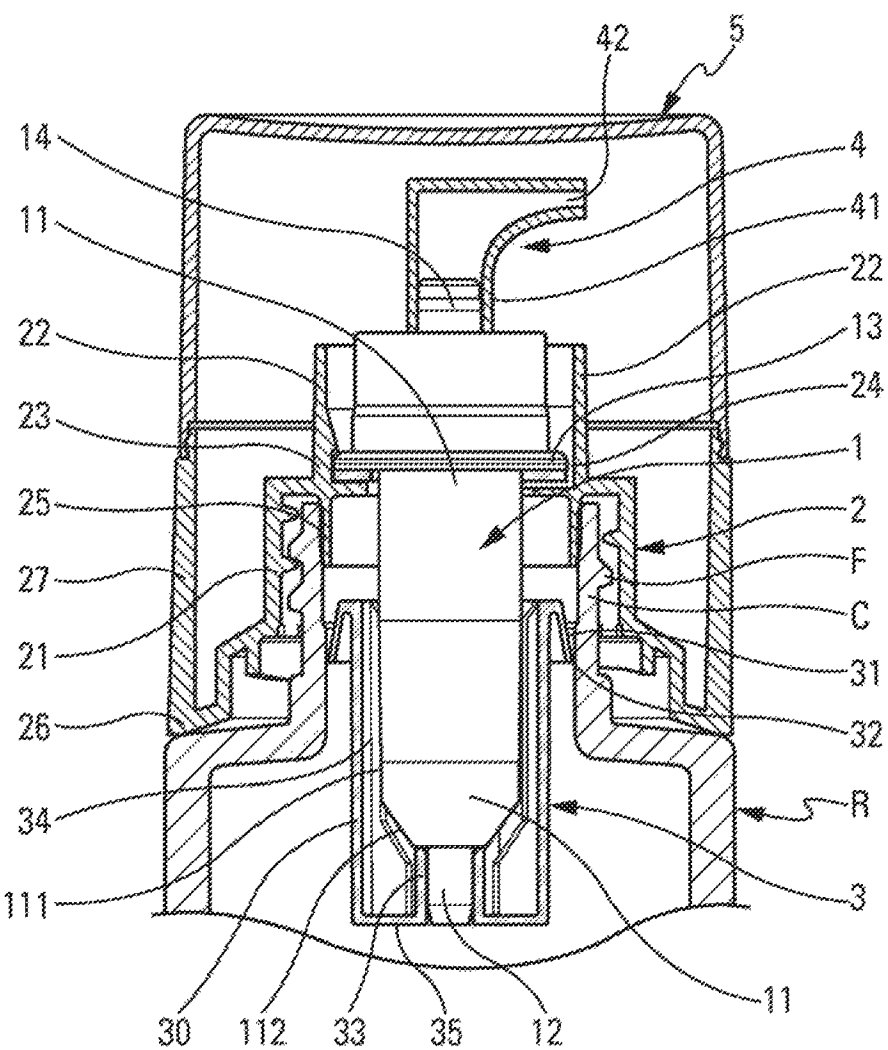
FIG. 2 is a vertical section view through the FIG. 1 dispenser.
Figure 1:
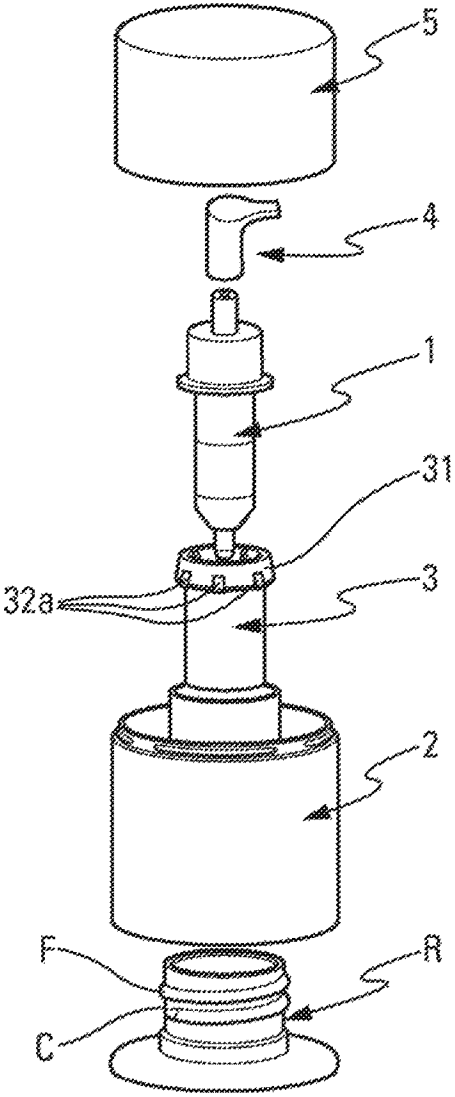
FIG. 1 is an exploded perspective view of a dispenser in a first embodiment of the invention.

Reference is made firstly to FIGS. 1 and 2 in order to describe in detail the first embodiment of the invention. A dispenser member 1, that may be a pump or a valve, is provided with a sleeve 3 that forms a vent lip 31. The dispenser member 1 is assembled on a fastener ring 2 that is itself assembled on a fluid reservoir R. The dispenser member 1 is further provided with a dispenser head 4 that forms a dispenser orifice 42. Optionally, the dispenser head 4 may be covered with a protective cap 5 that is assembled on the fastener ring 2 in this particular embodiment. The dispenser head 4 and the protective cap 5 are not critical to the present invention, which lies in the sleeve 3 provided with its vent lip 31.

In entirely conventional manner, the dispenser member 1 includes a body 1 in which a valve rod 14 is axially movable back and forth. For a pump, the valve rod 14 serves to vary the volume of a pump chamber in which a dose of fluid is put under pressure. A piston is generally assembled on the valve rod. For a valve, the valve rod 14 serves to open an outlet valve, enabling the fluid under pressure to be dispensed. Whether a pump or a valve, this has no influence on the present invention. In this embodiment, the body 11 is provided with an inlet tube 12 that internally defines a fluid inlet. The body 11 also includes a collar 13 that projects radially outwards. Between the collar 13 and the inlet tube 12, the body 11 defines a main portion 111 and a transition portion 112 that may be frustoconical. It should be observed that the main portion 111 of the body 11 presents a constant diameter (or a plurality of stepped diameters) that is greater than the diameter of the inlet tube 12. The axial dimension of the main portion 111 is much greater than the axial dimension of the inlet tube 12 or of the transition portion 112. This configuration is entirely conventional for a pump body or valve in the fields of perfumery, cosmetics, and pharmacy.

The fastener ring 2 serves to hold the body 11 of the dispenser member 1 in stationary manner on the neck of a fluid reservoir. In the embodiment used to illustrate the present invention, the fluid reservoir R defines a neck C of small diameter that is provided externally with a thread F. The fastener ring 2 includes a skirt 21 that is threaded internally so as to make it possible to co-operate with the external thread F of the neck C of the reservoir R. The fastener ring 2 also includes a bushing 22 that defines a reception housing 23 for the projecting collar 13 of the dispenser member 1. By way of example, the collar 13 may be snap-fastened, advantageously in permanent manner, in the reception housing 23 of the bushing 22. The reception housing 23 may form one or more vent passages 24, such that the collar 13 is snap-fastened in the reception housing 23 in a manner that is not leaktight. At its bottom end, the bushing 22 may form a self-sealing lip 25 for coming into engagement with the inside the neck C of the reservoir R. At its bottom end, the fastener skirt 21 forms an abutment 26 that comes into contact with a shoulder of the reservoir R. The fastener ring 2 also forms a trim 27 that extends in coaxial manner around the skirt 21 and the bushing 22. At its top end, the trim 27 may form an annular snap-fastener profile.

The dispenser head 4 forms a connection sleeve 41 that is engaged in stationary and leaktight manner around the free end of the valve rod 14. The head 4 also forms a dispenser orifice 42 downstream from the valve rod 14, so that the fluid may be collected there by the user. This is an entirely conventional embodiment for a dispenser head.

The protective cap 5 covers the dispenser head 4 and may come to snap-fasten in removable manner on the free end of the trim 27 of the fastener ring 2.

All of the component elements described above may be of entirely conventional type.

In the invention, the body 11 of the dispenser member 1 is provided with a sleeve 3 that is engaged axially around the body 11, below the collar 13. The sleeve 3 is preferably engaged around the body 11 starting from its bottom end where the inlet tube 12 is formed. The sleeve 3 is made out of a relatively flexible plastics material, such as an elastomer. It is also possible to envisage making the sleeve 3 by bi-injection of two plastics materials of different hardnesses. The sleeve 3 includes a main cylindrical section 30 that is engaged around the body 11 over a certain axial height starting from the inlet tube 12. More precisely, the main cylindrical section 30 surrounds the inlet tube 12, the transition portion 112, and the main portion 111. At its bottom end, the main cylindrical section 30 is connected to an annular flange 35 that extends substantially level with the bottom end of the inlet tube 12. Then, the sleeve 3 forms a sealing sheath 33 that is engaged in leaktight manner around the inlet tube 12, in such a manner as to create a good sealing at this location. A vent lip 31 runs on from the top end of the main cylindrical section 30, which vent lip points outwards and downwards and is terminated by an end edge 32 that comes into leaktight contact with the inside wall of the neck C, as can be seen clearly in FIG. 2. Internally, the main cylindrical section 30 is provided with vertical axial splines that come into bearing contact against the main portion 111 of the body 11. It should be observed that the vent lip 31 is situated axially remote from the sealing sheath 33. It can even be said that the vent lip 31 is closer to the collar 13 than to the inlet tube 12. Thus, the behavior and the operation of the vent lip 31 are completely decorrelated with, and independent of, the state of deformation of the sealing sheath 33 that is engaged around the inlet tube 12. In addition, the vertical splines 34 provide the vent lip 31 with sufficient support to avoid any unwanted deformation of the main portion 111 of the body 11. The splines 34 also make it easy to engage the sleeve 3 around the pump body without excessive friction force. The sealing sheath 33 is engaged around the inlet tube 12 only at the end of engagement, over a stroke that is relatively short compared to the height of the sleeve 3. The engagement of the sealing sheath 33 around the inlet tube 12 thus provides sealing, and the engagement of the main section 30 around the main portion 111 provides good stability. Furthermore, the deformation of the lip has absolutely no influence on the sealing sheath 33, since they are remote from each other.

It is advantageous for the vent lip 31 to be somewhat deformed against the inside wall of the neck C, so as to provide good sealing and a certain amount of pre-compression. The internal space situated above the vent lip 31 around the pump body 11 may communicate with the outside through the vent passages 24 formed at the reception housing 23 of the bushing 22. Thus, outside air can penetrate into the reservoir when the suction inside said reservoir exceeds a predetermined threshold that corresponds to the pre-compressed state of the vent lip 31 against the inside wall of the neck C. In contrast, the fluid stored inside the reservoir R cannot escape between the bushing 22 and the vent lip 31 because of its pre-compressed state. The dispenser can thus easily be used upsidedown, with the reservoir R situated above the dispenser member 1.

In a practical embodiment, the vent lip 31 may be provided with one or more small beads 32*a* (FIG. 1) of very small size that extend to the outer edge 32. The beads 32*a* create one-way leakage at the contact between the lip 31 and the ring 2, enabling outside air to penetrate into the reservoir, but preventing any fluid from flowing from the reservoir to the outside. One-way flow is possible because of the great difference in viscosity between air and the fluid, in particular when the fluid is a cream or a gel.

With regard to the assembly operation for assembling the dispenser, it should be observed that the sleeve 3 may be put into place around the body 11 of the dispenser member 1 while said dispenser member is already assembled in its reception housing 23. Given that the sleeve 3 is engaged axially around the body 11, this operation can be easily automated.

The sleeve 3 thus makes it possible to provide the dispenser member 1 with a vent lip 31 that co-operates with the neck C and not with the body 11, as in the above-mentioned prior art. Even if the body 11 is subjected to a certain amount of deformation as a result of being assembled in the fastener ring 2 or as a result of the valve rod 14 being moved, the vent lip 31 is not affected, given that it does not co-operate directly with the body 11.

Figure 3:
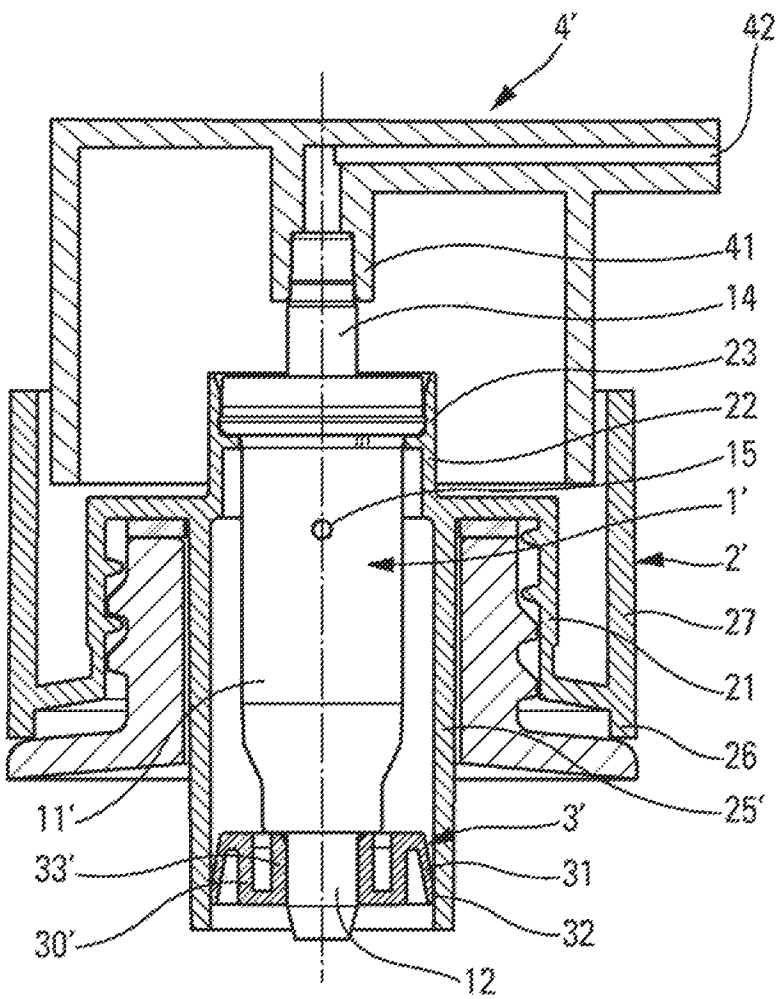
FIG. 3 is a view similar to the view in FIG. 2, showing a second embodiment of the invention.

FIG. 3 shows a second embodiment that differs from the first mainly in that the vent lip 31 co-operates with the fastener ring 2', and no longer with the neck C. The fastener ring 2' of the second embodiment forms a seat for the vent lip 31. More precisely, the ring 2' includes a tube 25' that extends downwards through the neck C and even projects below the neck. The tube 25' replaces the lip 25 of the first embodiment. The outer edge 32 of the lip 31 comes into bearing contact against the inside wall of the tube 25', in the proximity of its bottom end.

Another difference resides in the fact that the vent passage is no longer formed in the reception housing, but rather through the dispenser member 1' that is provided with an internal vent system comprising a vent hole 15 that is formed in the body 11'. This is an entirely conventional characteristic for an atmospheric pump that enables air to be taken in. Thus, it is possible to use an entirely conventional pump and an entirely conventional fastener ring given that, in this embodiment, the vent lip 31 co-operates with the fastener ring 2', and no longer with the neck C.

Figure 4:
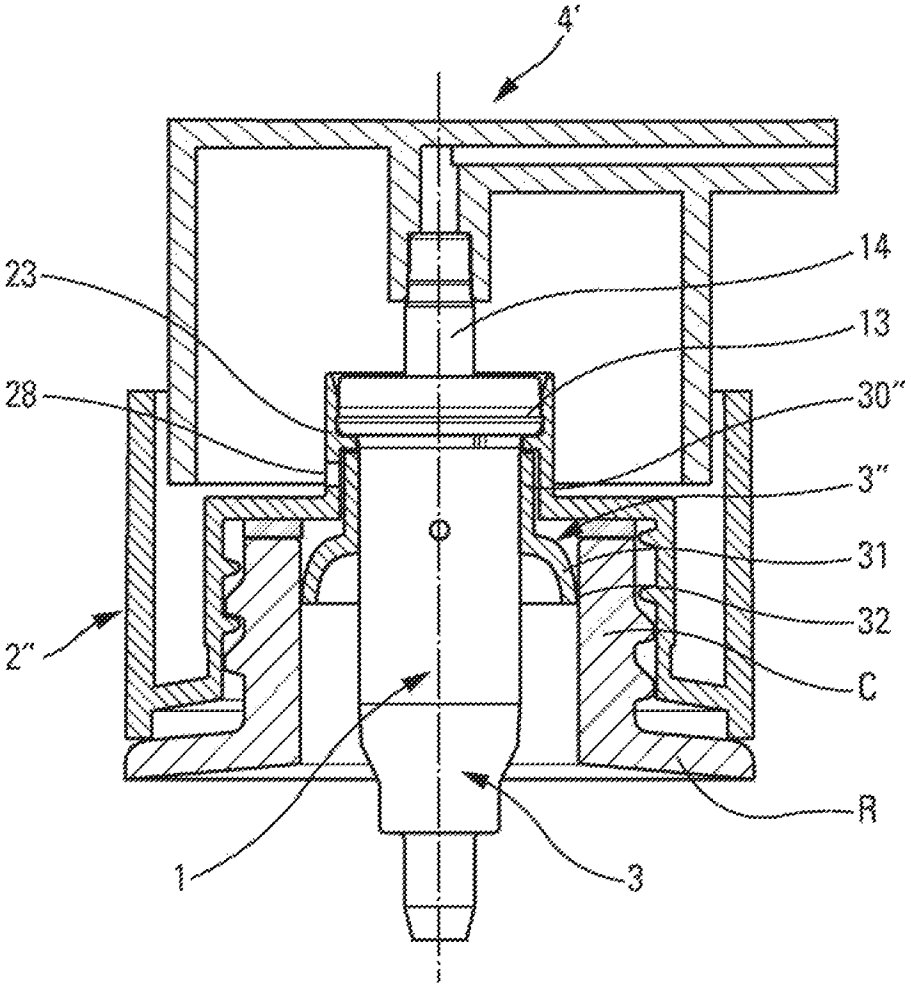
FIG. 4 is a view similar to the views in FIGS. 2 and 3, showing a third embodiment of the invention.

FIG. 4 shows a third embodiment in which the sleeve 3" has a main cylindrical section 30" that is engaged in leaktight manner around the body 11 and that extends upwards into the proximity of the collar 13 in the reception housing 23. The sealing lip 31 is identical to the sealing lip of the first two embodiments, pointing outwards and downwards. As in the first embodiment, the vent lip 31 comes into bearing leaktight contact against the inside wall of the neck C. In this embodiment, venting with the outside advantageously takes place through a vent hole 28 that is formed in the fastener ring 2". Thus, outside air may penetrate into the reservoir R through the hole 28 and between the lip 31 and the neck C. As in the second embodiment, the pump may be assembled in leaktight manner in its reception housing, e.g. by means of a neck gasket. The dispenser member 1 may be an airless or atmospheric pump, given that the main cylindrical section 30" of the sleeve 3" is positioned at the top portion of the body that is situated below the collar 13, a location in which the vent passage is generally situated.

By means of the present invention, a sleeve can be engaged in leaktight manner around the body of the dispenser member and can include a vent lip 31 that points outwards in such a manner as to come into leaktight contact, advantageously bearing contact, against another element of the dispenser, such as the fastener ring or the reservoir. The decoupling between the permanent seal against the body and the selective seal of the vent lip makes it possible to avoid any interference between the two seals.

The invention claimed is:

1. A dispenser member, comprising a body defining an inlet tube and in which a valve rod is axially movable back and forth, the body being provided with a vent lip that extends around the body, pointing outwards and downwards towards the inlet tube, thereby defining an outer edge that is not in contact with the body, the vent lip being formed by a sleeve that is engaged axially around the body to form a seal between them, the sleeve forming a leaktight sheath that is engaged in leaktight manner around the inlet tube of the body;

the dispenser member being characterized in that the vent lip is situated axially above the sealing sheath.

2. The dispenser member according to claim 1, wherein the body defines a main portion and a transition portion that connects the inlet tube to the main portion, the main portion presenting a diameter that is greater than the diameter of the inlet tube, the sleeve forming a main section that extends around the main portion, the vent lip being connected to the top end of the main section, pointing outwards and downwards.

3. The dispenser member according to claim 1, wherein the sleeve forms axial contact splines at the vent lip, the axial contact splines coming into bearing contact against the body.

4. The dispenser member according to claim 3, wherein the axial contact splines come into contact with the main portion of the body.

5. The dispenser member according to claim 1, wherein the body includes a collar at a top end of the body, the vent lip being closer to the collar than to the inlet tube.

6. A dispenser including a dispenser member according to claim 1, the dispenser member being assembled on a fluid reservoir by a fastener ring, the outer edge of the vent lip coming into leaktight contact with the fastener ring or with the fluid reservoir.

7. The dispenser according to claim 6, wherein the dispenser member is assembled in non-leaktight manner on the fastener ring.

8. The dispenser according to claim 6, wherein the fastener ring includes a vent hole.

9. The dispenser member according to claim 1, wherein the dispenser member is a pump or a valve.

10. The dispenser member according to claim 1, wherein the body defines a main portion having a diameter larger than a diameter of the inlet tube and wherein the leaktight sheath is engaged in leaktight manner around the inlet tube of the body at a location axially below the main portion when the dispenser member is upright, and wherein the vent lip extends around at least a portion of the main body and not around the inlet tube.

11. A dispenser member, comprising:

a body defining an inlet tube at a bottom of the body;

a rod axially movable relative to the body;

a vent lip that extends around the body, extending outwards and downwards, thereby defining an outer edge spaced from the body;

a sleeve engaged axially around the body, the sleeve forming a sheath engaged in leaktight manner around the inlet tube of the body;

the vent lip forms a one-piece construction with the sleeve; and the vent lip is located axially above the sealing sheath.

12. The dispenser member according to claim 11, wherein the body defines a main portion that transitions to the inlet tube, the main portion having an outer diameter that is greater than an outer diameter of the inlet tube, and a portion of the sheath engaged around the inlet tube defines an opening with a diameter corresponding to the outer diameter of the inlet tube to ensure leaktight engagement.

13. The dispenser member according to claim 12, wherein the sheath comprises a main cylindrical section connected to an annular flange, and the annular flange, in turn, is connected to the portion of the sheath engaged around the inlet tube, the main cylindrical section of the sheath having an outer diameter that is greater than an outer diameter of the portion of the sheath engaged around the inlet tube.

14. The dispenser member according to claim 11, wherein the body defines a main portion having a diameter larger than a diameter of the inlet tube and wherein the sheath is engaged in leaktight manner around the inlet tube of the body at a location axially below the main portion when the dispenser member is upright, and wherein the vent lip extends around at least a portion of the main body and not around the inlet tube.

* * * * *